US009624072B2

(12) United States Patent
Kuisma

(10) Patent No.: US 9,624,072 B2
(45) Date of Patent: Apr. 18, 2017

(54) ELEVATOR HAVING A LIGHT CURTAIN FIXING ARRANGEMENT

(71) Applicant: KONE CORPORATION, Helsinki (FI)

(72) Inventor: Petri Kuisma, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 401 days.

(21) Appl. No.: 14/227,251

(22) Filed: Mar. 27, 2014

(65) Prior Publication Data

US 2014/0305746 A1 Oct. 16, 2014

(30) Foreign Application Priority Data

Apr. 12, 2013 (EP) ..... 13163453

(51) Int. Cl.
*B66B 13/14* (2006.01)
*B66B 5/00* (2006.01)
*B66B 13/26* (2006.01)

(52) U.S. Cl.
CPC ..... *B66B 5/0012* (2013.01); *B66B 13/26* (2013.01)

(58) Field of Classification Search
CPC ..... B66B 5/0012; B66B 13/26
USPC ..... 187/247, 313, 316, 317, 413; 49/26, 28, 49/118, 138; 250/221, 239; 340/555, 340/556
See application file for complete search history.

(56) References Cited

U.S. PATENT DOCUMENTS 3,370,677 A * 2/1968 Federmann ..... B66B 13/26 187/317
3,834,081 A * 9/1974 Catlett ..... E05F 15/646 49/118
4,976,337 A 12/1990 Trett
5,394,961 A * 3/1995 Biver ..... B66B 13/26 187/313
5,641,951 A * 6/1997 Cai ..... B66B 13/26 187/317
5,712,458 A * 1/1998 McCandless ..... B66B 13/26 187/317
6,710,325 B2 * 3/2004 Kuhar ..... G08B 13/183 250/221
6,774,352 B2 * 8/2004 Koyama ..... B66B 13/26 250/221
7,348,536 B2 * 3/2008 Bockel ..... G01V 8/20 250/221
7,755,024 B2 7/2010 Platt et al.
(Continued)

FOREIGN PATENT DOCUMENTS

CN 101184686 A 5/2008
EP 0 699 619 A2 3/1996
(Continued)

*Primary Examiner* — Anthony Salata
(74) *Attorney, Agent, or Firm* — Birch, Stewart, Kolasch & Birch, LLP

(57) ABSTRACT

The elevator includes an elevator car with a door construction including at least one door panel opening and closing a passage to the elevator car. The light curtain includes a longitudinal transmitter and a longitudinal receiver facing towards each other. The fixing arrangement includes at least one longitudinal support device including a longitudinal support member having a cross section in the form of a letter U, whereby the letter U forms a slot for receiving the transmitter or the receiver of the light curtain.

15 Claims, 6 Drawing Sheets

(56) References Cited

U.S. PATENT DOCUMENTS

| | | | | |
|---|---|---|---|---|
| 7,771,080 | B2 * | 8/2010 | Platt | B66B 13/26<br>187/317 |
| 8,646,206 | B2 * | 2/2014 | Gilchrist | E06B 7/28<br>340/573.1 |
| 9,304,034 | B2 * | 4/2016 | Ishikawa | G01J 1/0271 |
| 2008/0204229 | A1 | 8/2008 | Platt et al. | |
| 2015/0315834 | A1 * | 11/2015 | Collins | E05F 15/40<br>49/26 |

FOREIGN PATENT DOCUMENTS

| | | | |
|---|---|---|---|
| JP | 10-310353 | A | 11/1998 |
| JP | 2000-118928 | A | 4/2000 |
| JP | 2002-145566 | A | 5/2002 |
| JP | 2003-89489 | A | 3/2003 |

* cited by examiner

10 - elevator car
21 - walls of elevator shaft 20
50 - first door construction
51, 52 - door panels of first door
60 - second door construction
61, 62 - door panels of second door
63, 64 - second door frames
100 - fixing arrangement

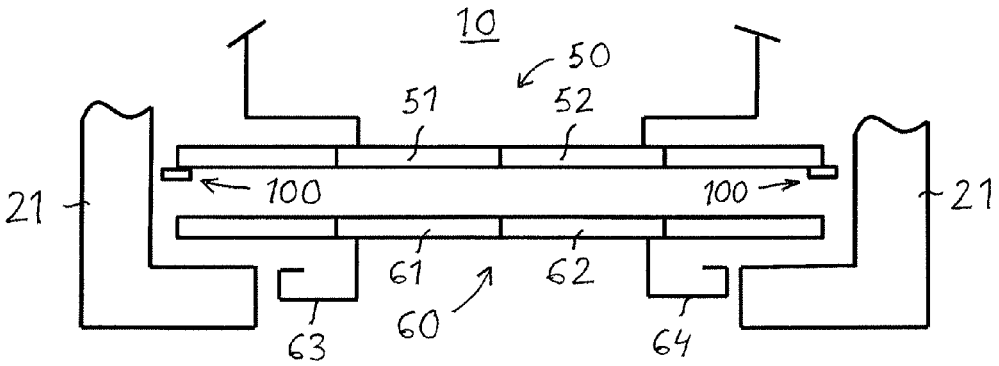

FIG. 3

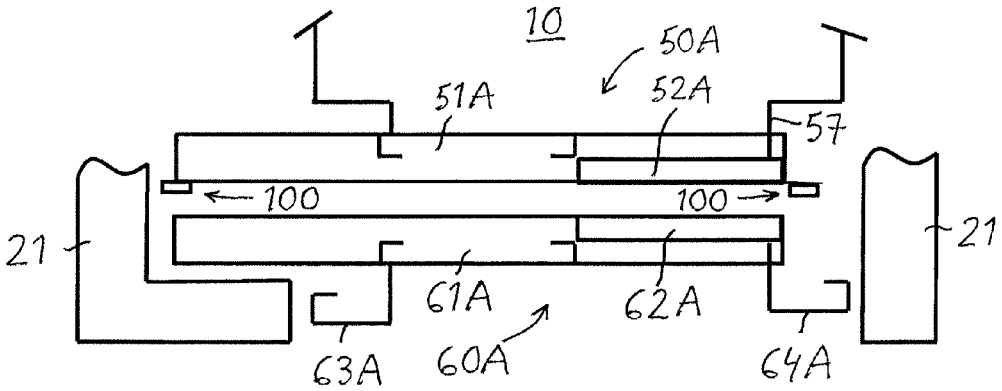

FIG. 4

10 - elevator car
21 - walls of elevator shaft 20
50A - first door construction
51A, 52A - door panels of first door
57 - slam post
60A - second door construction
61A, 62A - door panels of second door
63A, 64A - door frame of second door
100 - fixing arrangement 10 - elevator car
21 - walls of elevator shaft 20
50 - first door construction
51, 52 - door panels of first door
60 - second door construction
61, 62 - door panels of second door
63, 64 - second door frames
100 - fixing arrangement

ELEVATOR HAVING A LIGHT CURTAIN FIXING ARRANGEMENT

FIELD OF THE INVENTION

The invention relates to a fixing arrangement for a light curtain in an elevator.

The elevator comprises an elevator car with a door construction comprising at least one door panel opening and closing a passage to the elevator car. The light curtain to be fastened with the fixing arrangement comprises a longitudinal transmitter and a longitudinal receiver facing towards each other.

BACKGROUND ART

A light curtain in an elevator comprises two opposite vertical detectors at a horizontal distance from each other. One detector comprises a transmitter and the other detector comprises a receiver. The transmitter comprises a number of light emitting diodes emitting infrared light which is directed with a lens system towards the opposite receiver. When an object enters the region between the transmitter and the receiver some of the infrared beams sent by the transmitter will be obscured. The receiver will detect that some infrared beams are missing and this will activate a safety function which will prevent the closing of the door panels. The light curtain functions thus as a safety device preventing people and goods from being pressed between the door panels when the door panels are to be closed. The door panels will close automatically when a certain time has passed after they have opened unless the light curtain prevents closing of the door panels.

A sliding door construction in an elevator comprises a horizontal railing, a horizontal sill and at least one door panel. The upper end of the at least one door panel is supported with rolls at the railing and the lower end of the at least one door panel is supported with gliding means at the sill. There are centre opening door constructions and side opening door constructions. In a centre opening door construction the door panels on both sides of the centre of the door construction move in opposite directions. In a side door construction the door panels move in the same direction.

In a centre opening door construction, the first detector (transmitter or receiver) and the second detector (receiver of transmitter) are positioned at opposite outer ends of the railing and the sill so that the first detector and the second detector face towards each other. The fixing arrangement in prior art solutions comprises an L-shaped vertically extending support profile. The upper end of the support profile is attached with a bracket and a screw to the railing and the lower end of the support profile is attached in a corresponding way with a bracket and a screw to the sill. The first detector and the second detector are attached to the plane surface of the respective support profile with screws.

The vertically between the railing and the sill extending support profile becomes rather long. The support profile is thus problematic to pack together with the other equipment in the door construction. When the vertical support profile is made of one piece it suits only one door height. Vertical support profiles of different length must thus be kept in stock to suit different door heights. There are also solutions where the vertical support profile is made of two separate pieces. The two separate pieces are then attached to each other with pop-rivets at the installation site. This will cause a longer installation time and a risk of installation mistakes.

Holes are needed in the transmitter and the receiver in order for the screws to pass through the transmitter and the receiver when the transmitter and the receiver are attached to the vertical support profile. These holes in the transmitter and the receiver will decrease the IP-class of the light curtain.

In a side opening door construction, the first detector (transmitter or receiver) can be attached in the same way as in a centre opening door construction to the end of the railing and to the end of the sill at that end of the door construction towards which the door panel opens. The fixing of the second detector (receiver or transmitter) is in a prior art solution done to the slam post against which the door panel closes. The second detector is attached from the upper end and the lower end with a screw and a clamp to the slam post.

The light curtain has also been attached to the door panels in prior art solutions. The detector is in some prior art solutions positioned between an inner profile and a fixing plate. The whole package is then fastened with screws passing through the package to the inner surface of the door panel. The transmitter and the receiver is positioned against each other at the inner surface of the door panels at the opposite edges of the door panels in a centre opening door construction. In a side opening door construction the second detector would have to be fastened to the slam post against which the door panel closes. The second detector could be pre-installed at the door factory to the slam post so that the detector is flush mounted with the surface of the slam post. The edge of the door panel would thus close against the detector. The other possibility is to install the detector to the inner surface of the slam post, said inner surface being parallel with the door panel.

Prior art solutions in which the light curtain is attached to the door panels involve a risk that screw-heads cause scratches to the door panels. Prior art solutions require holes in the transmitter and the receiver in order for the fastening screws to pass through the transmitter and the receiver. These holes in the transmitter and the receiver will decrease the IP-class of the light curtain. Maintenance and replacement of a light curtain fastened with screws and/or brackets and/or clamps means that the screws and/or the brackets and/or the clamps have to be disassembled in order to be able to maintenance or replace the light curtain.

BRIEF DESCRIPTION OF THE INVENTION

An object of the present invention is to provide an improved fixing arrangement for a light curtain in an elevator.

The fixing arrangement is characterized in that it comprises at least one longitudinal support device comprising a longitudinal first support member having a cross section in the form of a letter U, whereby the letter U forms a slot for receiving the transmitter or the receiver of the light curtain.

The fixing arrangement according to the invention is easy and fast to install. The transmitter and the receiver of the light curtain can simply by pushed into the slot in the first support member. The transmitter and the receiver of the light curtain are then shape locked in the slot in the first support member. The transmitter and the receiver of the light curtain can further be pulled from the slot in the first support member when the transmitter and the receiver of the light curtain are to be maintained or replaced. No tools are needed in order to push the transmitter and the receiver of the light curtain into the slot or to pull the transmitter and the receiver of the light curtain from the slot in the first support member. Maintenance of the light curtain is thus fast and easy.

The fixing arrangement can be installed in advance to the door construction e.g. during the elevator installation. The transmitter and the receiver of the light curtain can then be pushed in place into the slot in the first support member at a later stage when the elevator will be handed over to normal use. The transmitter and the receiver of the light curtain will thus not be subjected to damage and dust during the elevator installation.

The fixing arrangement according to the invention provides a reliable and long lasting attachment for the light curtain. There will be less problems relating to the attachment of the light curtain during the lifetime of the light curtain compared to prior art solutions.

The fixing arrangement according to the invention can be used to attach the light curtain to a stationary part or to a mobile part of the elevator car door construction. The fixing arrangement could be attached to the railing and the sill or to the slam post of the door panels, which are stationary parts of the door construction. The fixing arrangement could on the other hand be attached to the door panels, which are mobile parts of the door construction.

BRIEF DESCRIPTION OF THE DRAWINGS

The invention will in the following be described in greater detail by means of preferred embodiments with reference to the attached drawings, in which

FIG. 3 shows a horizontal cross section of FIG. 2 with the corresponding landing door construction.

FIG. 4 shows a horizontal cross section of a side opening elevator car door construction with a fixing arrangement for a light curtain.

DETAILED DESCRIPTION OF EMBODIMENTS OF THE INVENTION

Figure 1:
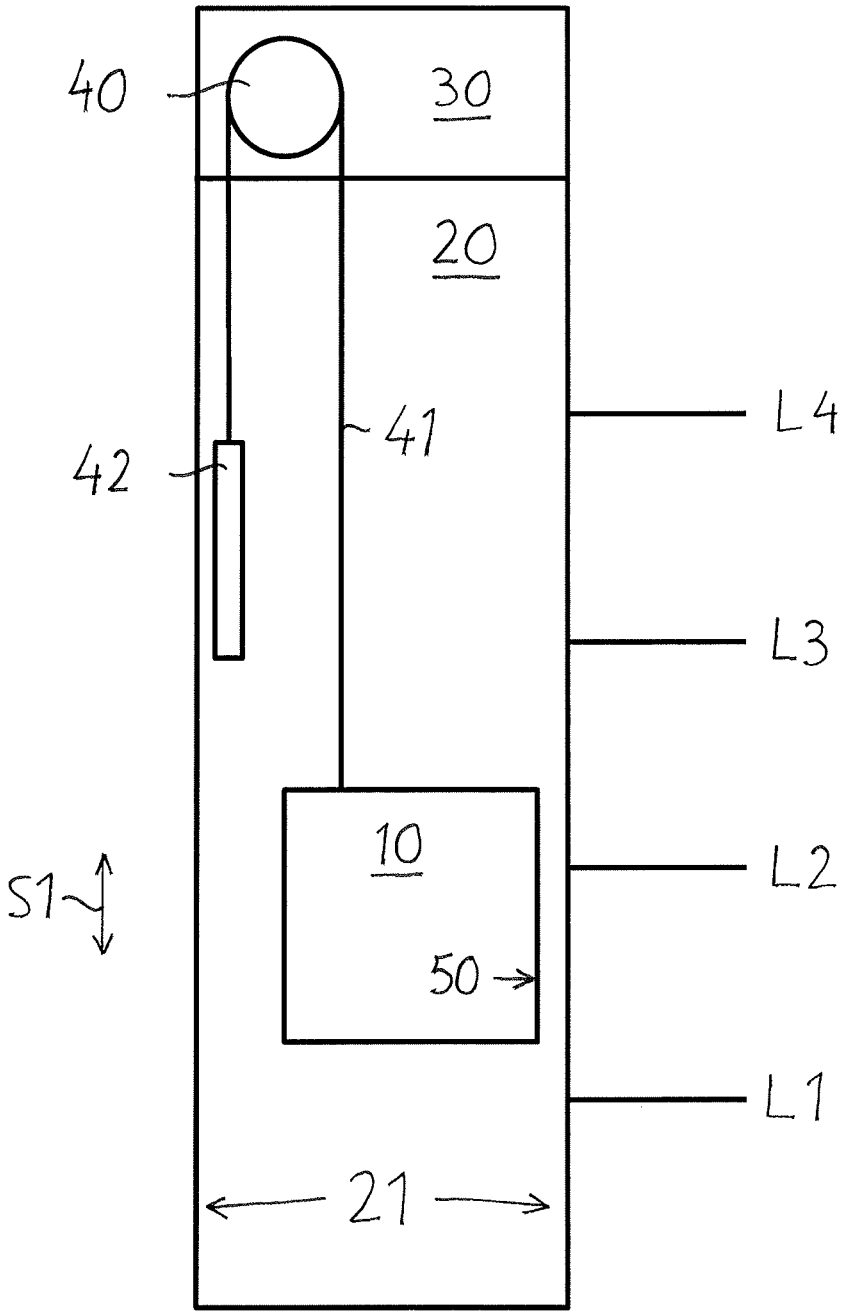
FIG. 1 shows a vertical cross section of an elevator.

FIG. 1 shows a vertical cross section of an elevator. The elevator comprises a car 10, an elevator shaft 20, a machine room 30, lifting machinery 40, ropes 41, and a counter weight 42. The lifting machinery 40 moves the car 10 in a first direction S1 upwards and downwards in the vertically extending elevator shaft 20. The walls 21 in the shaft 20 can be formed of an open steel structure or a closed concrete structure. The car 10 is carried by the ropes 41, which connect the car 10 to the counter weight 42. The car 10 is supported and guided with suitable means when moving upwards and downwards in the elevator shaft 20. The car 10 can be stopped at each landing L1 to L4 so that the floor 11 of the car 10 is at the same level as the floor of the landing L1 to L4. The car 10 comprises further a door arrangement 50 providing a passage in and out from the car 10 at the landings L1 to L4. The invention can naturally be used in any elevator type e.g. in elevators lacking machine room and/or counter weight.

Figure 2:
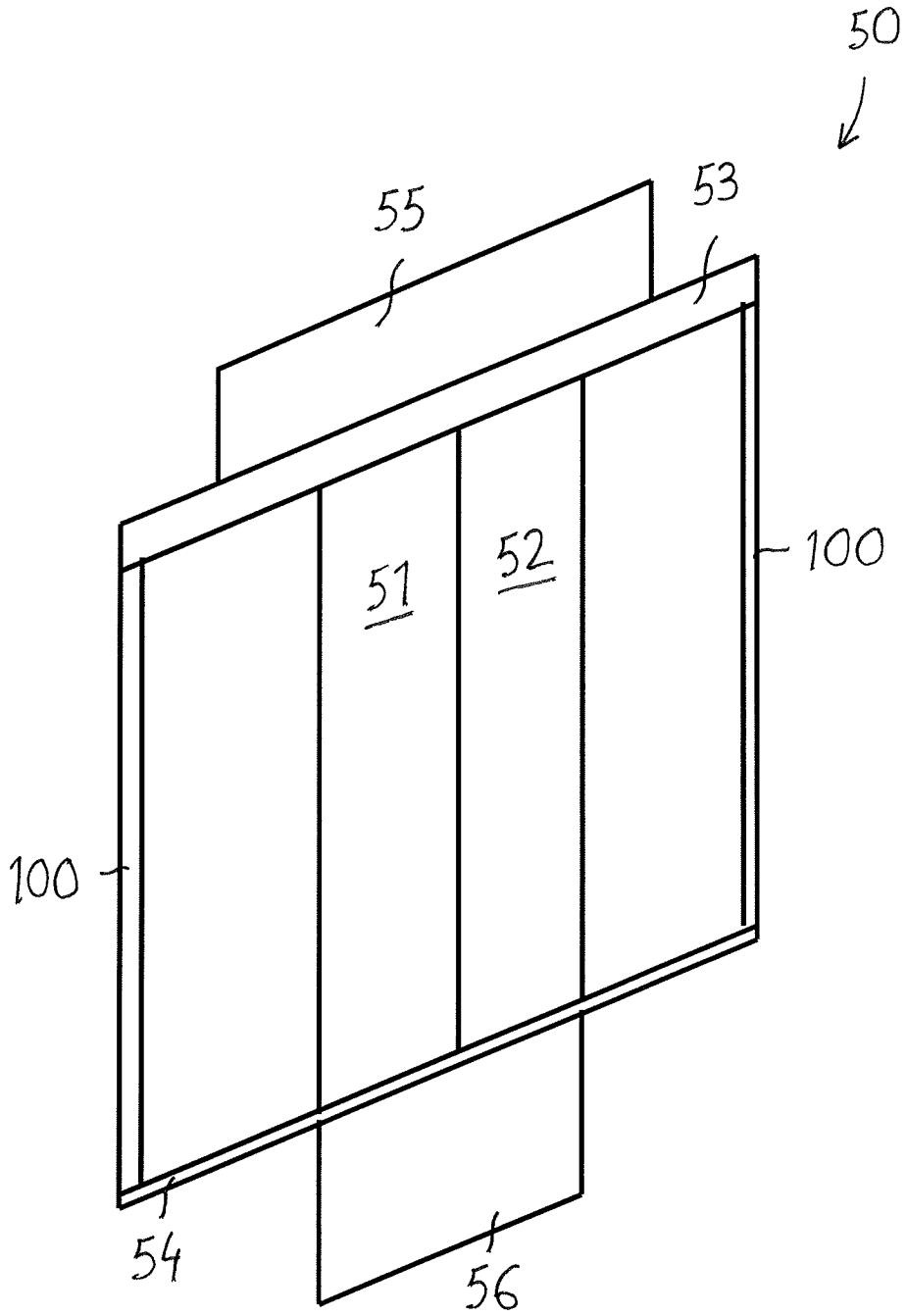
FIG. 2 shows an axonometric view of a centre opening elevator car door construction with a fixing arrangement for a light curtain.

FIG. 2 shows an axonometric view of a centre opening elevator car door construction with a fixing arrangement for a light curtain. The door construction 50 comprises two centre opened door panels 51, 52. The upper end of the door panels 51, 52 is supported with rolls on a horizontally extending railing 53. The lower end of the door panels 51, 52 is supported with gliding means on a horizontally extending sill profile 54. The gliding means extend into a groove in the sill 54. The door panels 51, 52 can thus be glided in the horizontal direction along the railing 51 supported by the rolls. The movement of the door panels 51, 52 is achieved with an electric motor that is connected with as such known driving machinery to the door panels 51, 52. The construction comprises further a support panel 55 above the railing 51 for parts of the driving machinery and a toe guard panel 56 below the sill 54. There is further a fixing arrangement 100 for the light curtain at each vertical outer edge of the door construction 50. The fixing arrangement 100 for the light curtain extends between the railing 53 and the sill 54. The upper end of the fixing arrangement 100 is supported at the railing 53 and the lower end of the fixing arrangement 100 is supported at the sill 54. The railing 53 and the sill 54 are attached to the elevator car 10. The support panel 55 is attached to the railing 53 and the toe guard panel 56 is attached to the sill 54. This means that the door panels 51, 52 open by moving outwards from the centre in the opposite direction towards the outer edges of the door construction 50. The door panels 51, 52 close by moving inwards from the outer edges of the door construction towards each other at the centre of the door construction 50.

FIG. 3 shows a horizontal cross section of FIG. 2 with the corresponding landing door construction. The figure shows the elevator car 10 door construction 50 and the corresponding landing L1 to L4 door construction 60. The elevator car 10 door construction 50 is attached to the elevator car 10 and travels thus with the elevator car 10 upwards and downwards in the shaft 20. The landing L1 to L4 door construction 60 is attached to the inner surface of the wall 21 in the shaft 20 at each landing L1 to L4. When the elevator car 10 stops at a landing L1 to L4 the door panels 61, 62 of the landing L1 to L4 will be connected to the door panels 51, 52 of the elevator car 10. The door panels 61, 62 of the landing L1 to L4 will thus move in a synchronized way with the door panels 51, 52 of the elevator car 10. The door panels 51, 52 of the elevator car 10 and the door panels 61, 62 of the landing L1 to L4 open by moving outwards to the outer edges of the respective door construction 50, 60 and close by moving inwards to the middle of the respective door construction 50, 60. The door panels 51, 52, 61, 62 in both door arrangements 50, 60 are centre opened. There are further door frames 63, 64 at the side edges of the opening to the shaft 20 at the landing L1 to L4. The fixing arrangement 100 for the light curtain is shown at the vertical outer edges of the car 10 door construction 50.

FIG. 4 shows a horizontal cross section of a side opening elevator car door construction with a fixing arrangement for a light curtain. Both door panels 51A, 52A in the elevator car 10 door construction 50A move in the same direction when the door opens and closes. The door panels 51A, 52A open so that the first door panel 52A moves first to the left in the figure and when the first door panels 52A is parallel with the second door panel 51A both door panels 51A, 52A move further to the left to the leftmost outer edge of the car 10 door construction 50A. The door panels 61A, 62A in the landing L1 to L4 door construction 60A move in a corresponding manner as the door panels 51A, 52A in the elevator car 10 door construction 50A. The door panels 51A, 52A, 61A, 62A are side opened in both door constructions 50A, 60A. There are further door frames 63A, 64A at the side edges of the opening to the shaft 20 at the landing L1 to L4. The fixing arrangement 100 for the light curtain is shown at the vertical outer edges of the car door construction 50A. The fixing arrangement 100 for the light curtain positioned to the left in the figure extends between the railing 53 and the sill 54 so that the upper end of the fixing arrangement 100 is supported at the railing 53 and the lower end of the fixing arrangement 100 is supported at the sill 54. The fixing arrangement 100 for the light curtain positioned to the right in the figure is advantageously attached directly to the slam post of the elevator car 10 door construction 50. The fixing arrangement 100 for the light curtain positioned to the right in the figure could, however, also extend between the railing 53 and the sill 54 so that the upper end of the fixing arrangement 100 is supported at the railing 53 and the lower end of the fixing arrangement 100 is supported at the sill 54. This would require that the railing 53 and the sill 54 extend beyond the slam post.

Figure 5:
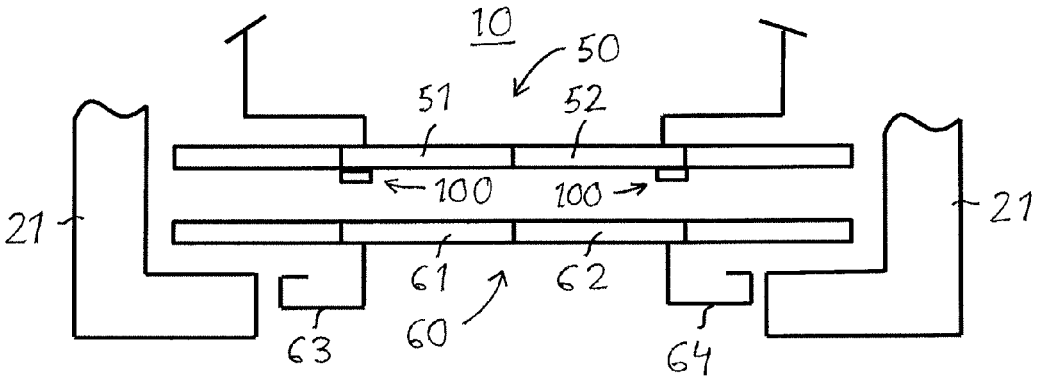
FIG. 5 shows the door construction in FIG. 3 with a different fixing arrangement for a light curtain.

FIG. 5 shows the door construction in FIG. 3 with a different fixing arrangement for a light curtain. The elevator car door construction 50 and the landing door construction 60 in FIG. 5 correspond to those in FIG. 3. There are two centre opened door panels 51, 52, 61, 62. The difference is in the position of the fixing arrangement 100 for the light curtain. The fixing arrangement 100 is in this embodiment positioned at the outer back edges of the door panels 51, 52. The fixing arrangement 100 is thus attached directly to the door panels 51, 52 of the elevator car door arrangement 50. This means that both fixing arrangements 100 will move together with the door panels 51, 52.

Figure 6:
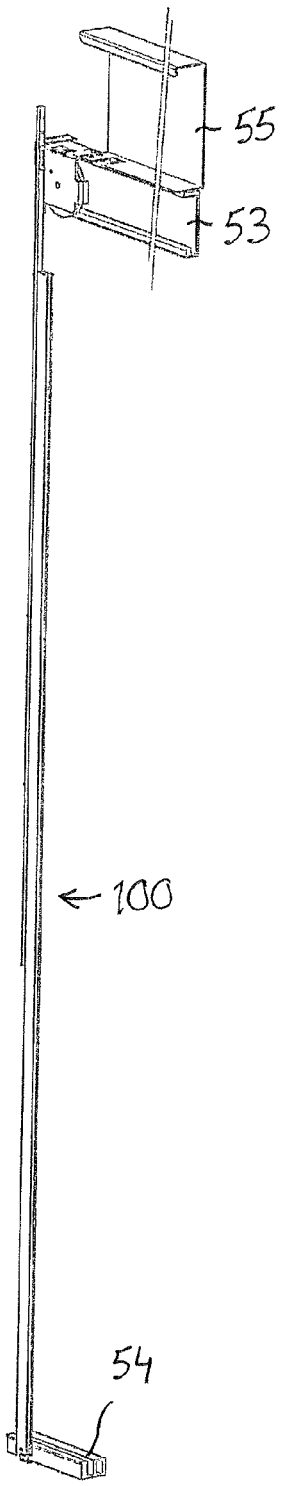
FIG. 6 shows a perspective view of a first embodiment of a fixing arrangement for a light curtain according to the invention.
Figure 7:
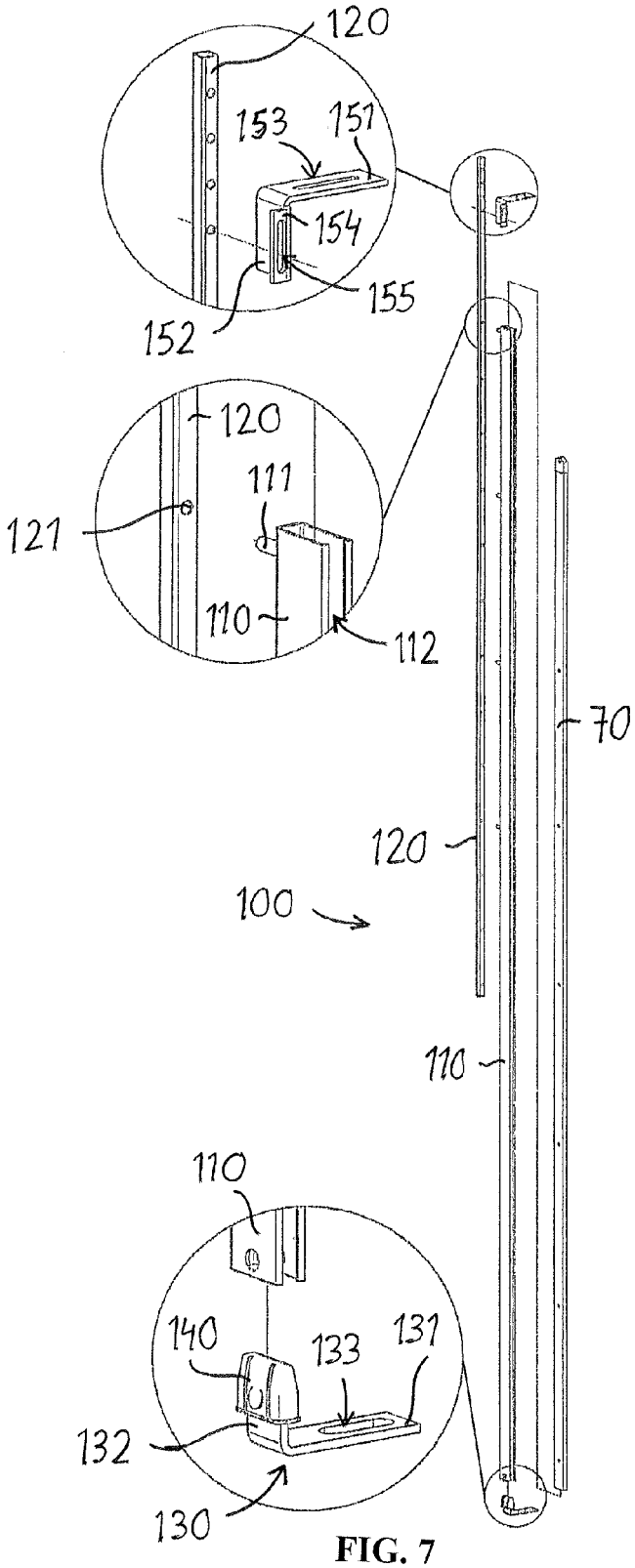
FIG. 7 shows an exploded view of the arrangement in FIG. 6.

FIG. 6 shows a perspective view of a first embodiment of a fixing arrangement for a light curtain according to the invention and FIG. 7 shows an exploded view of the arrangement in FIG. 6. The lower end of the fixing arrangement 100 is attached to the sill 54 and the upper end of the fixing arrangement 100 is attached to the railing 53. The fixing arrangement 100 comprises a longitudinal support device 110, 120 comprising a longitudinal first support member 110 and a longitudinal second support member 120. The horizontal cross section of the first support member 110 has the form of a laying letter U. The horizontal cross section of the second support member 120 is rectangular with a hollow interior i.e. the second support member 120 comprises four walls. The upper end portion of the first support member 110 comprises a number of plugs 111 extending outwards from the bottom of the first support member 110. The plugs 111 can be welded or riveted to the bottom surface of the first support member 110. The lower end portion of the second support member 120 comprises first apertures 121 extending through the second support member 120 i.e. through opposite walls in the second support member 120. The cross section of the plugs 111 and the cross section of the first apertures 121 are advantageously circular. The plugs 111 of the first support member 110 can thus be pushed into the first apertures 121 of the second support member 120 so that a desired length of the fixing arrangement 100 is achieved. The plugs 111 are advantageously provided with external threads whereby nuts can be used on the outer end of the plugs 111 to secure the first support member 110 to the second support member 120.

The length of the fixing arrangement 100 can be simply altered by altering the apertures 121 in the second support member 120 into which the plugs 111 in the first support member 110 are inserted.

The fixing arrangement 100 comprises further a first support bracket 130 having the form of a letter L. The horizontal branch 131 of the first support bracket 130 can be fastened to the bottom of the sill 54. The fastening can be done e.g. by a screw passing through an aperture 133 in the horizontal branch 131 of the first support bracket 130 and a nut. A clip 140 e.g. of plastic can be pushed on the vertically upwards extending branch 132 of the first support bracket 130. The lower end of the first support member 110 can thus be pushed on the clip 140 in order to secure a safe attachment of the first support member 110 to the first support bracket 130 and thereby to the sill 54. The first support bracket 150 can be attached to the sill 54 before the sill 54 is attached to the car 10. The technician can thus simply push the lower end of the first support member 110 on the clip 140 without the need to be able to work below the elevator car 10.

The fixing arrangement 100 comprises further a second support bracket 150 having the form of a letter L. The letter L is turned 90 degrees clockwise around the corner of the letter L so that the vertical branch of the letter L extends vertically downwards. The horizontal branch 151 of the second support bracket 150 can be fastened to the upper surface of the railing 53. The fastening can be done e.g. by a screw passing through an aperture 153 in the horizontal branch 151 of the second support bracket 150 and a nut. The vertically downwards extending branch 152 of the second support bracket 150 can be attached to the second support member 120. There is a fold 154 in the vertically downwards extending branch 152 of the second support member 150. The upper end portion of the second support member 120 comprises further second apertures 122. The upper end portion of the second support member 120 can thus be secured to the second support bracket 150 by a bolt passing through a second aperture 122 in the second support bracket 120 and further through an aperture 155 in the fold 154 in the second bracket 150.

The first support member 110 forms a slot 112 for receiving the light curtain 70. The light curtain 70 can thus simply be pushed into the slot 112. The light curtain 70 comprises two detectors i.e. a longitudinal transmitter and a longitudinal receiver. The outer dimensions and the form of the two detectors are identical. This means that the first support member 110 can receive the transmitter or the receiver of the light curtain 70.

Figure 8:
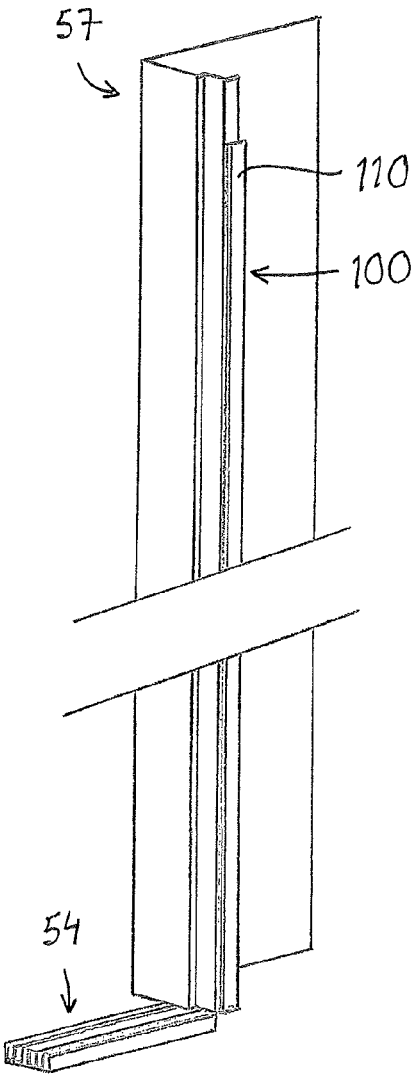
FIG. 8 shows a perspective view of a second embodiment of a fixing arrangement for a light curtain according to the invention.
Figure 9:
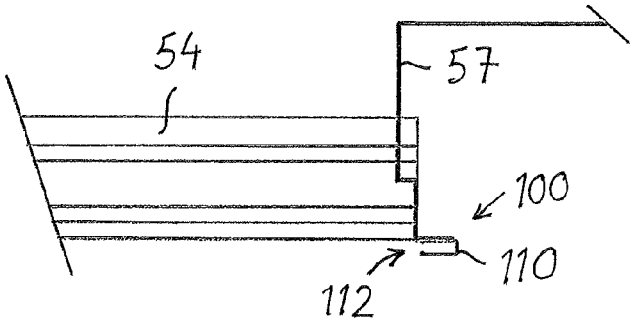
FIG. 9 shows an exploded view of the arrangement in FIG. 8.

FIG. 8 shows a perspective view of a second embodiment of a fixing arrangement for a light curtain according to the invention and FIG. 9 shows an exploded view of the arrangement in FIG. 8. The fixing arrangement 100 in this embodiment comprises a support device 110 comprising only the first support member 110 with the slot 112 for receiving the light curtain 70. There is thus no second support member 120 in this embodiment. The first support member 110 can be attached to the car 10 door front wall slam post 57. The first support member 110 can be fastened by glue, by tape or by spot welding to the car door 10 front wall slam post 57. This fixing arrangement 100 can be used to attach the first support member 110 directly to the door panels 51, 52 in FIG. 5. This fixing arrangement can also be used to attach the first support member 110 directly to the slam post 57 at the right in FIG. 4.

Figure 10:
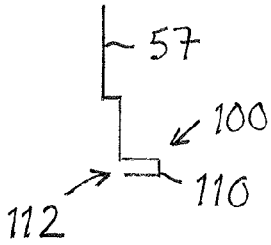
FIG. 10 shows a variant of the arrangement in FIG. 9.

FIG. 10 shows a variant of the arrangement in FIG. 9. The first support member 110 is in this variant integrated into the car 10 door front wall slam post 57. This means that the slam post 57 is formed so that the slam post 57 already comprises in itself the first support member 110. The first support member 110 is thus not a separate part that is attached to the slam post 57. This arrangement could also be applied to the construction in FIG. 5. The first support members 110 could in FIG. 5 be integrated into the door panels 51, 61 instead of using separate first support members 110 that are attached to the door panels 51, 52.

The door constructions in the figures comprise two door panels 51, 52, 51A, 52A. The door construction could, however, comprise any number of door panels. There could be only one door panel or there could be more than two door panels e.g. four door panels in the door construction.

The door constructions in the figures only show sliding door panels 51, 52, 51A, 52A. The inventive fixing arrangement 100 for the light curtain could, however, also be used in door constructions where the door panels are supported by hinges.

The figures show two embodiments of the fixing arrangement 100 for the light curtain 70. The support device 110, 120 comprises in the first embodiment shown in FIGS. 6 and 7 the first support member 110 and the second support member 120 attached to each other as well as the first support bracket 130 and the second support bracket 150. The support device 110 comprises in the second embodiment shown in FIGS. 8 and 9 only the first support member 110. The first support member 110 is in FIGS. 8 and 9 a separate entity, but an integral part of the door construction in the variant shown in FIG. 10. The first embodiment of the fixing arrangement 100 can be attached to a stationary part of the door construction 50, 50A i.e. to the railing 53 and the sill 54. The second embodiment of the fixing arrangement 100 can be attached to a stationary part of the door construction 50, 50A i.e. to the car 10 door front wall slam post 57 or to a moving part of the door construction 50, 50A i.e. the door panels 51, 52.

The second support bracket 150 in FIGS. 6 and 7 could be modified so that the vertical branch 152 comprises a round tube. The tube can slide into the upper end of the second support member 120. The diameter of the round tube is such that it fits tightly into the rectangular cross section of the second support member 120. The horizontal branch 151 of the second support bracket 150 can correspond to that shown in FIGS. 6 and 7 i.e. it could comprise a flat bar with on aperture 153.

The size and the dimensions of the first support member 110 could naturally be adapted according to the size and dimensions of the transmitter and the receiver. The first support member 110 will accommodate to small variations in the thickness of the transmitter and the receiver. Major changes in the thickness of the transmitter and the receiver will, however, require change of the first support member 110.

The parts in the fixing arrangement 100 are advantageously made of metal or of metal alloy. The material thickness is chosen so that the light curtain is pressed with a sufficient pressure within the first support member 110.

It will be obvious to a person skilled in the art that, as the technology advances, the inventive concept can be implemented in various ways. The invention and its embodiments are not limited to the examples described above but may vary within the scope of the claims.

The invention claimed is:

1. An elevator comprising:

an elevator car with a door construction comprising at least one door panel opening and closing a passage to the elevator car, a light curtain comprising a longitudinal transmitter and a longitudinal receiver facing towards each other, and a fixing arrangement for the light curtain, wherein the fixing arrangement comprises at least one longitudinal support device comprising a longitudinal first support member having a cross section in the form of a letter U, whereby the letter U forms a slot for receiving the transmitter or the receiver of the light curtain, and wherein an upper end of the fixing arrangement is attached to a horizontally extending railing.

2. The elevator according to claim 1, wherein at least one door panel is a sliding door panel, whereby an upper end of the at least one door panel is supported on the horizontally extending railing and a lower end of the at least one door panel is supported on a horizontally extending sill.

3. The elevator according to claim 2, wherein the door construction comprises at least two centre opening sliding door panels.

4. The elevator according to claim 3, wherein the fixing arrangement comprises two longitudinal support devices positioned at the vertical outer edges of the door construction so that the slots of the two longitudinal support devices and thereby also the transmitter and the receiver of the light curtain face towards each other, whereby an upper end of each of the two longitudinal support devices is supported at the railing and an lower end of each of the two longitudinal support devices is supported at the sill.

5. The elevator according to claim 4, wherein each of the two longitudinal support devices comprises a longitudinal first support member and a longitudinal second support member being attached to each other, whereby a lower end of each of the two longitudinal first support members is attached with a first support bracket to the sill and an upper end of each of the two longitudinal second support members is attached with a second support bracket to the railing.

6. The elevator according to claim 5, wherein the first support bracket has the form of a letter L, whereby a horizontal branch of the first support bracket is attached to the sill and the lower end of the longitudinal first support member is attached to a vertical branch of the first support bracket, and the second support bracket has the form of a letter L turned 90 degrees clockwise, whereby a horizontal branch of the second support bracket is attached to the railing and an upper end of the longitudinal second support member is attached to the vertical branch of the second support bracket.

7. The elevator according to claim 5, wherein an upper end portion of each of the two longitudinal first support members comprises plugs extending outwards from a bottom of the first support member and a lower end portion of each of the two longitudinal second support members comprises first apertures passing through the longitudinal second support member, whereby the first apertures receive the plugs establishing attachment between the longitudinal first support member and the longitudinal second support member.

8. The elevator according to claim 2, wherein the door construction comprises at least one side opening sliding door panel.

9. The elevator according to claim 8, wherein the fixing arrangement comprises two longitudinal support devices positioned at the vertical outer edges of the door construction so that the slots of the two longitudinal support devices and thereby also the transmitter and the receiver of the light curtain face towards each other, whereby a first one of the two longitudinal support devices is attached to a slam post towards which the at least one door panel closes and a second one of the two support devices is supported from the upper end at the railing and from the lower end at the sill.

10. The elevator according to claim 9, wherein the first one of the two support devices comprises only a longitudinal first support member and the second one of the two support devices comprises a longitudinal first support member and a longitudinal second support member being attached to each other, whereby the first one of the two support devices is attached directly to the slam post towards which the at least one door panel closes and the second one of the two support devices is attached with a first support bracket from a lower end of the longitudinal first support member of the longitudinal second support device to the sill and with a second support bracket from an upper end of the longitudinal second support member of the longitudinal second support device to the railing.

11. The elevator according to claim 10, wherein the first support bracket has the form of a letter L, whereby a horizontal branch of the first support bracket is attached to the sill and the lower end of the longitudinal first support member of the longitudinal second support device is attached to a vertical branch of the first support bracket, and the second support bracket has the form of a letter L turned 90 degrees clockwise, whereby a horizontal branch of the second support bracket is attached to the railing and an upper end of the longitudinal second support member of the longitudinal second support device is attached to the vertical branch of the second support bracket.

12. The elevator according to claim 10, wherein an upper end portion of the longitudinal first support member of the longitudinal second support device-comprises plugs extending outwards from a bottom of the longitudinal first support member of the longitudinal second support device and a lower end portion of the longitudinal second support member of the longitudinal second support device comprises first apertures passing through the longitudinal second support member of the longitudinal second support device, whereby the first apertures receive the plugs establishing attachment between the longitudinal first support member of the longitudinal second support device and the longitudinal second support member of the longitudinal second support device.

13. The elevator according to claim 3, wherein the fixing arrangement comprises two longitudinal support devices positioned so that the slots of the two longitudinal support devices and thereby also the transmitter and the receiver of the light curtain face towards each other, each longitudinal support device comprising only a longitudinal first support member, whereby a first one of the two longitudinal first support members is attached directly to a first door panel and the second one of the two longitudinal first support members is attached directly to a second door panel.

14. The elevator according to claim 6, wherein an upper end portion of each of the two longitudinal first support members comprises plugs extending outwards from a bottom of the first support member and a lower end portion of each of the two longitudinal second support members comprises first apertures passing through the longitudinal second support member, whereby the first apertures receive the plugs establishing attachment between the longitudinal first support member and the longitudinal second support member.

15. The elevator according to claim 11, wherein an upper end portion of the longitudinal first support member of the longitudinal second support device comprises plugs extending outwards from a bottom of the longitudinal first support member of the longitudinal second support device and a lower end portion of the longitudinal second support member of the longitudinal second support device comprises first apertures passing through the longitudinal second support member of the longitudinal second support device, whereby the first apertures receive the plugs establishing attachment between the longitudinal first support member of the longitudinal second support device and the longitudinal second support member of the longitudinal second support device.

* * * * *